US006519990B1

(12) United States Patent
Olsson et al.

(10) Patent No.: US 6,519,990 B1
(45) Date of Patent: Feb. 18, 2003

(54) METHOD AND A DEVICE FOR CONTROLLING A ROLLING MILL

(75) Inventors: Mats Olsson, Västerås (SE); Dag Sollander, Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/743,478

(22) PCT Filed: Jul. 9, 1999

(86) PCT No.: PCT/SE99/01247

§ 371 (c)(1),
(2), (4) Date: Mar. 15, 2001

(87) PCT Pub. No.: WO00/02677

PCT Pub. Date: Jan. 20, 2000

(30) Foreign Application Priority Data

Jul. 10, 1998 (SE) ..... 9802492

(51) Int. Cl.[7] ..... B21B 37/68
(52) U.S. Cl. ..... 72/12.7; 72/8.9; 72/11.6
(58) Field of Search ..... 72/8.6, 8.9, 9.2, 72/11.4, 11.6, 11.8, 12.7

(56) References Cited

U.S. PATENT DOCUMENTS 4,845,969 A * 7/1989 Niino et al. ..... 72/11.4
5,791,182 A * 8/1998 Ciani ..... 72/8.9
6,055,834 A * 5/2000 Della Vedova et al. ..... 72/11.6
6,112,566 A * 9/2000 Palzer et al. ..... 72/8.9

FOREIGN PATENT DOCUMENTS

| | | |
|---|---|---|
| EP | 0 775 537 | 5/1997 |
| GB | 2009974 | 6/1979 |
| JP | 55-045585 | 3/1980 |
| JP | 57-088908 | 6/1982 |
| SE | 227 270 | 9/1969 |
| SE | 314 733 | 9/1969 |
| SE | 444 274 | 4/1986 |
| SU | 1738400 | 6/1992 |
| SU | 1794517 | 2/1993 |

* cited by examiner

*Primary Examiner*—Ed Tolan
(74) *Attorney, Agent, or Firm*—Connolly Bove Lodge & Hutz LLP

(57) ABSTRACT

A method of controlling a rolling mill comprising at least two mill stands (1,2) arranged after each other, wherein a first stand (1) is arranged upstream of a second stand (2). Each of said stands comprises two spaced rolls (3,4,5,6). An elongated material (8) is fed between the rolls of each stand by rotating the rolls. The width of the material (8) is measured at a location downstream of said second stand (2), and if the measured width is not within predefined first upper and lower limit values, an interstand tension between said first (1) and said second stand (2) is adjusted to a value corresponding to the deviation of the measured width from said predefined limit values in order to control the width of said material (8), to be within said first upper and lower limit values.

18 Claims, 1 Drawing Sheet

METHOD AND A DEVICE FOR CONTROLLING A ROLLING MILL

FIELD OF THE INVENTION

The present invention is related to a method for controlling a rolling mill comprising at least two mill stands arranged after each other, wherein a first stand is arranged upstream of a second stand, each of said stands comprising two spaced rolls, wherein an elongated material is fed between the rolls of each stand by rotating the rolls, the width of the material being measured at a location at least downstream of said first stand. More particularly, it relates to a rolling mill for the production of materials with shapes different from sheets or strips, such as rods and bars of various types.

The present invention is further related to a device for controlling a rolling mill.

PRIOR ART

A rolling mill normally comprises a plurality of mill stands arranged after each other. Each of said stands comprises two spaced rolls with parallel rotation axes. A material is fed between the rolls of each stand, and thereby rolled, by rotating the rolls. The rolled material will elongate and spread as the cross section of the rolled material is reduced as it passes through said stands. The cross section after each stand is defined by the passdesign and the layout of the mill. The cross section is defined by the height and the width of the material leaving a roll gap.

Typically, the rolls of a first stand rolls the material in a first direction, and the rolls of a second, adjacent stand rolls the material in a direction perpendicular to the first direction. Usually, the rolls of said first stand have horizontal rotation axes, and the rolls of said second stand have vertically directed rotation axes. Thus, a vertical dimension of the rolled material is reduced in said first stand and a horizontal dimension of the rolled material is reduced in said second stand.

Each of the rolls of each stand has a groove shaped for the specific, desired profile according to the passdesign for the rolled material. The depth of the grooves and the gap between the rolls determines the height of the rolled material in a direction perpendicular to the rotation axes of the rolls. The grooves of the rolls are worn during rolling and the gap between the rolls of a stand is therefore needed to be decreased.

The width of the material is defined in a direction parallel to the axes of the rolls. The width is affected by the spread that varies with temperature, material and the interstand tension between two stands. The spread is not constant from head to tail of a rolled billet.

To keep the different stands cross section constant and equal to the passdesign during rolling, the height must be compensated for roll wear and the width must be compensated for the spread from head to tail of a billet.

A rolling mill is typically divided into three sections, called a roughing, an intermediate and a finishing section. The material enters the roughing section first and is reduced in cross section during its passage of said sections.

The materials enter the roughing section as billets which have been heated to a previously determined temperature of, for example, around 1 000° C. for a typical steel. The billets may for example enter the first stand of the roughing section with a speed of around 0.5 m/s and dimensions of, for example, 140 mm×140 mm. As the material proceeds downstream through the rolling mill, it is reduced in cross section and accelerated in speed. The materials may for example exit the final stand of the finishing section at a speed of around 120 m/s with a diameter of, for example, 5.5 mm.

Today, primarily the cross section of the rolled material is controlled by the shape of the grooves and the distance between the rolls, roll gap, of each stand. In order to, in this way, achieve the desired cross sectional shape of the material downstream of a second mill stand, it is necessary that the back tension between said second stand and an upstream adjacent first stand, and the front tension between said second stand and an adjacent downstream stand is approximately zero.

In GB 2 009 974, a method of controlling a rolling mill is described. The width of a material is measured downstream of a second stand. Errors in the width are detected and the rotational speed of the rolls of said second stand is adjusted in a sense to minimise the detected errors in the width. The interstand tension between a first stand, arranged upstream of said second stand, and said second stand is measured by means of transducers, The roll separation of said first stand is thereafter adjusted in a sense to minimise the interstand tension. The purpose of the adjustments is to minimise the interstand tension and regulate the width by means of the roll separation and thus the mass flow. A disadvantage of this method is that the mechanical design of the stand must allow the roll gap to be operated under load, i.e. with material in the roll gap. Most mill stands of old design as well as modern cantilever stands will not meet this requirement. Another disadvantage is that transducers are needed for measuring and controlling the tension.

SUMMARY OF THE INVENTION

The object of the invention is to devise ways to achieve an accurate control of the dimensions of a rolled material. A further object of the invention is to provide a method for controlling the dimensions of the rolled material, that is applicable in any section of a rolling mill.

These objects are achieved in that, if the measured width is not within predefined first upper and lower limit values, an interstand tension between said first and second stand is adjusted to a value corresponding to the deviation of the measured width from said predefined limit values in order to control the width of said material to be within said first upper and lower limit values. Thus, different interstand tension values are required for compensating different widths. The interstand tension is further allowed to vary along the length of each material. Control of the interstand tension is used for regulating the width. In this way, no further action is needed for regulating the width. This implies that the rolls of each of the stands do not need to be operated against load. The production of a rolling mill arranged for being controlled with this method is therefore cost-effective.

The width of a first portion of the material is measured at said location. The width of a second portion of the material, said second portion being located behind said first portion in the feeding direction is controlled to be within said limit values.

According to a preferred embodiment of the invention, the width of the material is measured at a location downstream of said second stand. In this way, the interstand tension between the first and second stand is effectively adjusted by means of back tension.

According to another preferred embodiment of the invention, if the measured width exceeds the upper limit value, the rotational speed of the rolls of said first stand is decreased in relation to the rotational speed of the rolls of said second stand, and, if the measured width is below the lower limit value, the rotational speed of the rolls of said first stand is increased in relation to the rotational speed of the rolls of said second stand. By changing the rotational speed of the rolls of said first stand in relation to the rotational speed of rolls of said second stand, an accurate and easy control of the interstand tension is achieved.

According another embodiment of the invention, said measuring is performed a plurality of times for each material. Preferably, the measuring of said width and the corresponding adjustment of the interstand tension is performed with very small time intervals such as less than 0.05 seconds. In this way a very accurate control of the dimensions of the rolled material is achieved.

By substantially continues measuring the cross section key dimensions out of a second stand and controlling the width by changing the roll speed of a first stand allowing the back tension as well as front tension to change during rolling, there is no need for tension transducers or mill stands that can be operated against load. The roll gap is only controlled in between billets to compensate for roll wear. This method is simple, reliable and is applicable to all types of mill stands.

According to another embodiment of the invention, a position of the material is detected at a location between said first and second stand when the material is in contact with both said first and second stand, and that, if the detected position is not within defined position limit values, a present compressive stress in the material between said first and second stand is. According to the inventive method, the material is preferably fed along a substantially straight line between said stands. Due to that the cross sectional dimensions of the roiled material is controlled by adjusting the interstand tension, a compressive force in the material may arise between said first and second stand. An uncontrolled compression force in the roiled material may however lead to a cobble, which is an out-of-control situation during which the rolled material suddenly shoots out of the normal pathway between two mill stands and may be thrown all over the mill. Due to the last mentioned embodiment, a difference in position for the rolled material in relation to a desired pathway indicates an undesired bend of the material resulting from the compressive force in the material being too large. Decreasing the compressive stress in the material, the rolled material will be straightened out and a cobble is avoided.

The inventive device for controlling a rolling mill is more closely defined in the claims and the following description.

BRIEF DESCRIPTION OF THE DRAWINGS

With reference to the enclosed drawings a more close description of embodiment examples of the invention follows hereunder.

In the drawings.

DESCRIPTION OF PREFERRED EMBODIMENTS

Figure 1:
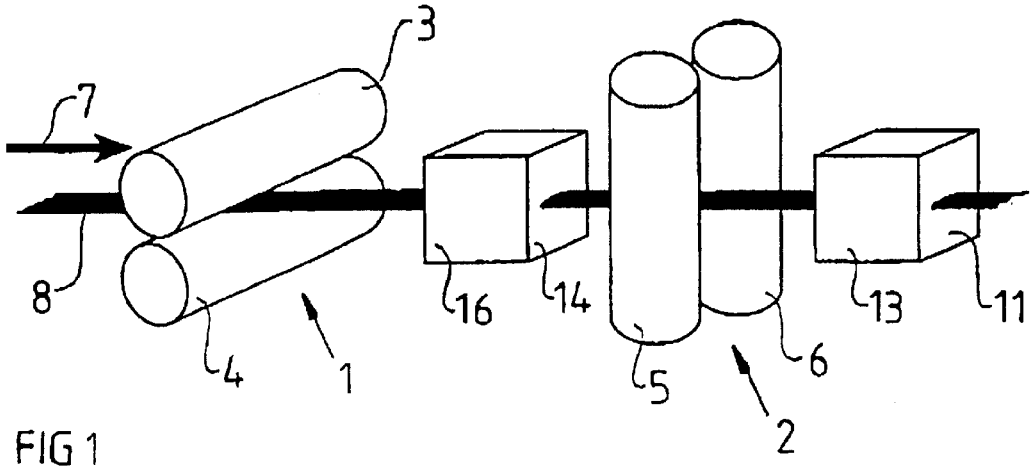
FIG. 1 is a schematical perspective view of a part of a rolling mill for rolling an elongated material.
Figure 2:
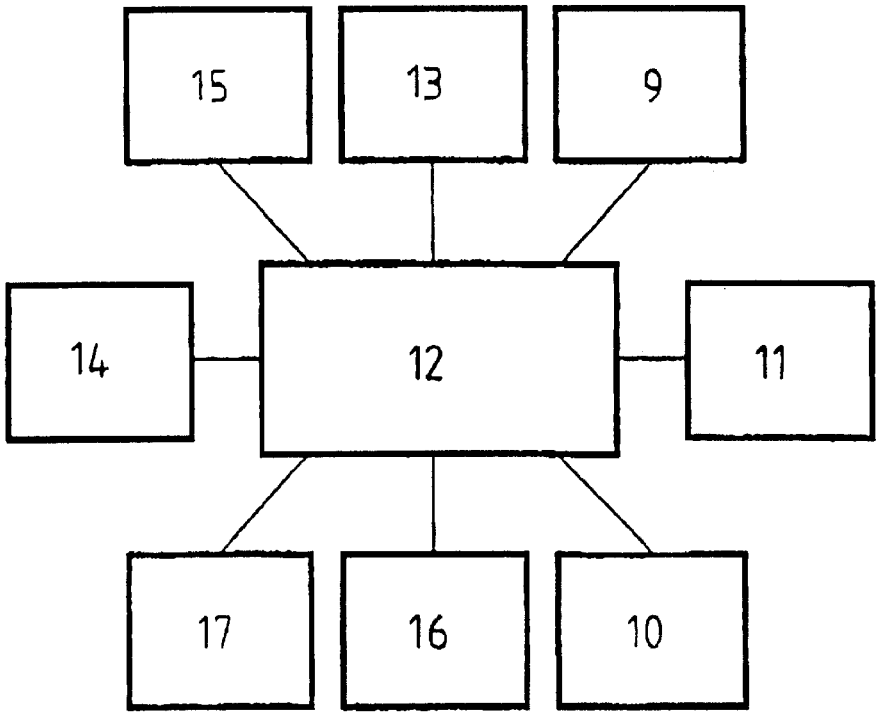
FIG. 2 is a block diagram of the device for controlling a rolling mill according to a first preferred embodiment.

Reference will in the following description be made both to FIG. 1 and FIG. 2. FIG. 1 illustrates a part of a rolling mill comprising two mill stands 1, 2. Each of the stands 1, 2 comprises two rolls 3, 4 and 5, 6, respectively. The rolls of each stand are arranged with parallel rotation axes. The rotation axes of the rolls 3, 4 of the first stand 1 in the feeding direction, see arrow 7, extend in a different direction in relation to the rotation axes of the rolls 5, 6 of the second stand 2. Preferably, the rotation axes of the rolls 5, 6 are inclined with 90° in relation to the rotation axes of the rolls 3, 4. In FIG. 1, the rotation axes of the rolls 3, 4 extend in a substantially horizontal direction and the rotation axes of the rolls 5, 6 extend in a substantially vertical direction. Each roll 3, 4, 5, 6 is preferably arranged with a groove, not shown, for controlling an elongated material 8 in the form of a bar or rod, and to provide the rolled material with a desired shape. The elongated material 8 is fed along a substantially straight line between said stands 1, 2. Said part of the rolling mill comprising said first stand 1 and said second stand 2 could be comprised in any section of the rolling mill.

Means 9, 10 for rotating the rolls 3, 4 and 5, 6, respectively are arranged. Said means 9, 10 for rotating the rolls 3, 4, 5, 6 are, for example, formed by electric motors. A first electric motor 9 controls the rotational speed of the rolls 3, 4 of said first stand and a second electric motor 10 controls the rotational speed of the rolls 5, 6 of said second stand.

According to an embodiment example, the elongated material 8 has a substantially circular cross sectional shape at portions thereof, which have not yet entered said first stand 1. The portions of the material 8 located between said first 1 and second stand 2 have a substantially oval cross sectional shape after having been rolled in the first stand 1. The portions of the material 8 located downstream of said second stand 2 again have a substantially circular shape, but with a smaller cross sectional area than the portions of the material 8 positioned upstream of said first stand. Thus, as the material 8 proceeds downstream, it is reduced in cross section and accelerated in speed.

The material 8 has a tendency to either spread out or form a waist in a direction parallel to the rotation axes of the rolls of a specific stand after having passed said stand. If the material spreads out beyond the contours of the groove, it is called overfill, and if it forms a waist, i.e. spreads less than the groove contour, it is called underfill.

A first means 11 for measuring the width of the material 8 is located downstream of said second stand 2. The width measurement indicates whether an undesired waist or spreading out of the material 8 is formed at the stand 2. The measured width of the material 8 is compared with predefined first upper and lower limit values. Said measured width being below said lower limit value indicates a present underfill of the material 8. Such a underfill is compensated for by decreasing the tensile stress in the material 8 between stand 1 and stand 2. This is effected by increasing the rotational speed of the rolls 3, 4 of said first stand 1 in relation to the rotational speed of the rolls 5, 6 of said second stand 2.

If the width measured by said first measuring means 11 exceeds the upper limit value, it indicates an undesired overfill of the material 8. In order to control the width of said material, or a subsequent material, to be below the upper limit value, the tensile stress in the material 8 should be increased between said first stand 1 and said second stand 2. This is effected by decreasing the rotational speed of the rolls 3, 4 of said first stand 1 in relation to the rotational speed of the rolls 5, 6 of said second stand 2.

A change in the rotational speed of the rolls 3, 4 of said first stand 1 in relation to the rotational speed of the rolls 5, 6 of said second stand 2 may be effected by only changing the rotational speed of the rolls 3, 4, by only changing the rotational speed of the rolls 5, 6, or by changing the rotational speed of both the rolls 3, 4 and the rolls 5, 6.

The first measuring means 11 is connected to a control unit 12. Said first upper and lower limit values are stored in the control unit 12. The control unit 12 is further connected to the means 9 for rotating the rolls 3, 4 of said first stand 1 and to the means 10 for rotating the rolls 5, 6 of said second stand 2. The width measured by the measuring means 11 is thus compared with said first upper and lower limit values in the control unit 12 and the rotation means 9, 10 are controlled correspondingly.

A second means 13 is arranged for measuring the height of the material 8. The second measuring means 13 is located downstream of said second stand 2. In the preferred embodiment shown in FIG. 1, said first and second measuring means are formed by one single measuring apparatus, in the following referred to as measuring means 11. If the measured height is not within second upper and lower limit values stored in the control unit 12 the distance between the rolls 5, 6 is to be changed. This is either done automatically or manually. According to the preferred example, a means 15 is arranged for adjusting the relative distance between the rolls 5, 6. Thus, when the measured height is not within the stored second upper and lower limit values, the control unit 12 sends a signal to the displacement means 15. The displacement preferably taking place in between billets. Alternatively, the control unit 12 notifies an operator that the measured height is not within the stored second upper and lower limit values and the operator manually effects the displacement of the rolls 5, 6.

A third means 14 is arranged for measuring the height of said material 8 between said first stand 1 and said second stand 2. The third measuring means 14 is connected to the control unit 12. The control unit 12 controls if the measured height is within third upper and lower limit values. A displacement means 17 is arranged for moving the rolls 3, 4 of said stand 1 in relation to each other, i.e. towards or away from each other. The displacement preferably taking place in between billets. The displacement means 17 is also connected to the control unit 12. It is of course also within the scope of the inventive claims to move the rolls manually in the same manner as has been described for the rolls 5, 6. Thus, the third measuring means 14 can be used for roll wear compensation in stand 1.

A means 16 is arranged between said first stand 1 and said second stand 2 for detecting a position of the material 8. The detection means 16 is connected to the control unit 12. Position limit values for the position of the material 8 are stored in the control unit 12. Preferably, the detected position is compared to a reference position corresponding to the material forming a straight line. A detected position of the material 8 outside said stored position limit values indicates that the material 8 does not extend along a substantially straight line anymore, and thus, too large compressive forces are present in the material 8. In order to avoid cobbles, which may lead to an uncontrolled spillage of the rolled material, the compressive stress in the material between said first stand 1 and said second stand 2 must be decreased. This is preferably accomplished in that the rotational speed of the rolls 3, 4 of said first stand 1 is decreased in relation to the rotational speed of the rolls 5, 6 of said second stand 2. Said detecting means 16 and said third measuring means 14 are in FIG. 1 formed by one single measuring/detecting apparatus. The detecting means 16 may for example detect the position of the rolled material 8 in both a vertical and a horizontal direction. According to a preferred embodiment, the detecting means 16 supports the material 8 in three directions, for example sideways and downwards. Thus, a compressive force in the material 8 results in the fact that the material moves upwards. This can easily be detected by, for example conventional sensors or photocells. Thus, the position detecting means 16 is arranged for avoiding a cobble between the first stand 1 and the second stand 2. Errors in width of the material resulting from the fact that the rotational speed of the rolls is controlled by the position detecting means 16 is taken care of in further stands downstream of said second stand 2.

According to a preferred embodiment example, presence of the material 8 at said second stand 2 is detected and said position limit values are defined based on a detection of the position of the material 8 at said location when a front end of the material has just entered said second stand.

Said measuring/detection is performed a plurality of times for each material or billet. The measuring/detection is further repeated with a time interval between each measuring/detection of less than 0.5 seconds, preferably less than 0.1 seconds and especially less than 0.05 seconds.

Said control unit comprises memory means, calculating means and means for receiving and sending information.

In the description above, said second stand 2 is arranged directly downstream of said first stand 1, i.e. no further stand is arranged between said first and second stand.

A measured width of said material being outside any of said control limit values results, according to an alternative embodiment, to adjustment of the rotational speed of the rolls or the distance between the rolls of further stands located upstream of stand 1 or downstream of stand 2. A detected undesired position of the material 8 between said first stand 1 and said second stand 2 results, according to a further alternative embodiment, to adjustments of the rotational speed of the rolls of further stands located upstream of said stand 1 and/or downstream of said stand 2.

Said detection/measuring may be performed either by electric magnetic devices or other means, for example optical equipment such as lasers or cameras, or combinations of optical methods and mechanical sensors.

The inventive method/device is of course also possible to use in combination with known techniques for controlling interstand tension, such as the above-mentioned method of controlling the output of the electric motors rotating the rolls.

It should be noted that the description presented here above only should be considered as exemplifying for the inventive idea, on which the invention is built. Thus, it is obvious for the skilled in the art that detailed modifications may be made without leaving the scope of the invention.

What is claim is:

1. A method for controlling a rolling mill comprising a first mill stand and a second mill stand located downstream of the first mill stand, each mill stand comprising two spaced rolls, the method comprising:

feeding an elongated material between the spaced rolls of the first and second mill stands by rotating the rolls of the mill stands;

measuring a width of the elongated material at a location downstream of the second mill stand;

adjusting, if the measured width is not within first upper and lower limit values, an interstand tension between the first and second mill stands, wherein the tension is adjusted to a value corresponding to a deviation of the measured width from the first upper and lower limit values, wherein said adjusting controls the width of the material to be within the first upper and lower limit values;

detecting a position of the elongated material at a location between the first and second mill stands when the material is in contact with both the first and second mill stands; and decreasing a compressive stress in the material between the first and second mill stands if the detected position is not within position limit values.

2. The method of claim 1, wherein if tie measured width of the elongated material exceeds the first upper limit value, the step of adjusting comprises:

decreasing the rotational speed of the rolls of the first mill stand in relation to the rotational speed of the rolls of the second mill stand.

3. The method of claim 1, wherein if the measured width of the elongated material is below the lower limit value, the step of adjusting comprises:

increasing the rotational speed of the first stand in relation to the rotational speed of the second mill stand.

4. The method of claim comprising:

measuring a height of the elongated material at a location downstream of the second mill stand; and adjusting the distance between the rolls of the second mill stand if the measured height of the material is not within second upper and lower limit values, wherein adjusting the distance between the rolls of the second mill stand controls the height of the elongated material to be within the second upper and lower limit values.

5. The method of claim 4, comprising:

measuring the height of the elongated material at a location downstream of the first mill stand; and adjusting the distance between the rolls of the first mill stand if the measured height is not within third upper and lower limit values, wherein adjusting the distance between the rolls of the first mill stand controls the height of the elongated material to be within the third upper and lower limit values.

6. The method of claim 1, wherein the measuring step is repeated.

7. The method of claim 6, wherein measuring is performed repeatedly with a time interval between each measuring of less than 0.5 seconds.

8. The method of claim 7, wherein measuring is performed repeatedly with a time interval between each measuring of less than 0.05 seconds.

9. The method of claim 1, wherein decreasing a compressive stress in the material comprises:

decreasing the rotational speed of the rolls of the first mill stand in relation to a rotational speed of the rolls of the second mill stand.

10. The method of claim 1, comprising:

detecting a presence of the elongated material at the second mill stand, wherein the position limit values are defined based on a detection of the position of the elongated material at the second mill stand when a front end of the elongated material has entered the second mill stand.

11. The method of claim 1, wherein feeding an elongated material comprises:

feeding elongated material along a substantially straight line between the first and second mill stands.

12. The method of claim 1, wherein the elongated material is substantially stiff between the, first and second mill stands.

13. A device for controlling a rolling mill, the rolling mill comprising a first mill stand located upstream of a second mill stand, each mill stand comprising two spaced rolls, and means for rotating the rolls in order to feed an elongated material between the rolls of each mill stand, the control device comprising:

first means for measuring the width of the elongated material located downstream of the second mill stand;

a control unit connected to the first measuring means and to the rotation means, wherein the control unit controls the means for rotating to adjust an interstand tension of the elongated material between the first and second mill stands to a value corresponding to a deviation of the measured width from first upper and lower limit values, if the measured width of the elongated material is not within the first upper and lower limit values; and means for detecting a position of the elongated material located between the first and second mill stands and connected to the control unit, wherein if the detected position is not within position limit values, the control unit controls the rotation means to decrease a present compressive stress in the elongated material located between the first and second mill stands.

14. The device of claim 13, wherein the control unit controls the rotation means so that the rotational speed of the rolls of the first mill stand is decreased in relation to the rotational speed of the rolls of the second mill stand when the measured width exceeds the first upper limit value.

15. The device of claim 13, wherein the control unit controls the rotation means so that the rotational speed of the rolls of the first mill stand is increased in relation to the rotational speed of the rolls of the second mill stand when the measured width is below the first lower limit value.

16. The device of claim 13, comprising:

second means for measuring the height of elongated material located downstream of the second till stand and connected to the control unit, wherein the control unit signals that the distance between tee rolls of the second mill stand should be changed to control the height of the elongated material to be within second upper and lower limit values when the measured height of the elongated material is not within the second upper and lower limit values.

17. A The device of claim 16, comprising:

third means for measuring the height of the elongated material located downstream of the first mill stand and connected to the control unit, wherein the control unit signals that the distance between the rolls of the first mill stand should be changed to control the height of the elongated material to be within third upper and lower limit values when the measured height of the elongated material is not within the third upper and lower limit values.

18. The device of claim 13, wherein the control unit controls the rotation means to increase the rotational speed of the rolls of the second mill stand in relation to the rotational speed of the rolls of the first mill stand when the detected position is not within the position limit values.

* * * * *